United States Patent [19]

Kerr et al.

[11] 4,118,012

[45] Oct. 3, 1978

[54] LOAD TRANSFER

[75] Inventors: Andrew Guy Kerr, Edinburgh, Scotland; Robert Arthur Morley, Southport, England

[73] Assignee: Ferranti Limited, Hollinwood, England

[21] Appl. No.: 772,253

[22] Filed: Feb. 25, 1977

[30] Foreign Application Priority Data

Feb. 28, 1976 [GB] United Kingdom ..... 07938/76

[51] Int. Cl.[2] ..... B66D 1/48

[52] U.S. Cl. ..... 254/173 R; 214/13; 212/3 R

[58] Field of Search ..... 254/173 R, 172, 186 R; 214/12, 13, 14, 15 R; 212/3 R; 240/421, 248 R

[56] References Cited

U.S. PATENT DOCUMENTS

| | | | |
|---|---|---|---|
| 1,999,936 | 4/1935 | Lange | 212/3 |
| 2,814,032 | 11/1957 | Agnew et al. | 214/12 |
| 3,189,195 | 6/1965 | Fox, Jr. et al. | 254/173 R |
| 3,189,196 | 6/1965 | Carl et al. | 254/173 R |
| 3,282,568 | 11/1966 | Shuster | 254/173 R |
| 3,365,075 | 1/1968 | Van Gils et al. | 254/173 R |
| 3,512,657 | 5/1970 | Chambers | 214/13 |

*Primary Examiner*—Trygve M. Blix
*Assistant Examiner*—Kenneth W. Noland
*Attorney, Agent, or Firm*—Cameron, Kerkam, Sutton, Stowell & Stowell

[57] ABSTRACT

Control of vertical motion of a suspended crane hook assembly to accommodate vertical motion between a station carrying the crane and a station carrying a load is achieved by a transducer on the hook assembly and a control cord depending onto the load station. Tension above a set value in the cord produced by a crew member on the station causes the hook assembly to descend and below the set value causes it to rise. Movement of the stations causes a continuous adjustment of tension and the hook assembly follows the motion, extra tension being applied to guide the hook assembly down to the load and vice versa.

9 Claims, 3 Drawing Figures

LOAD TRANSFER

Figure 1:
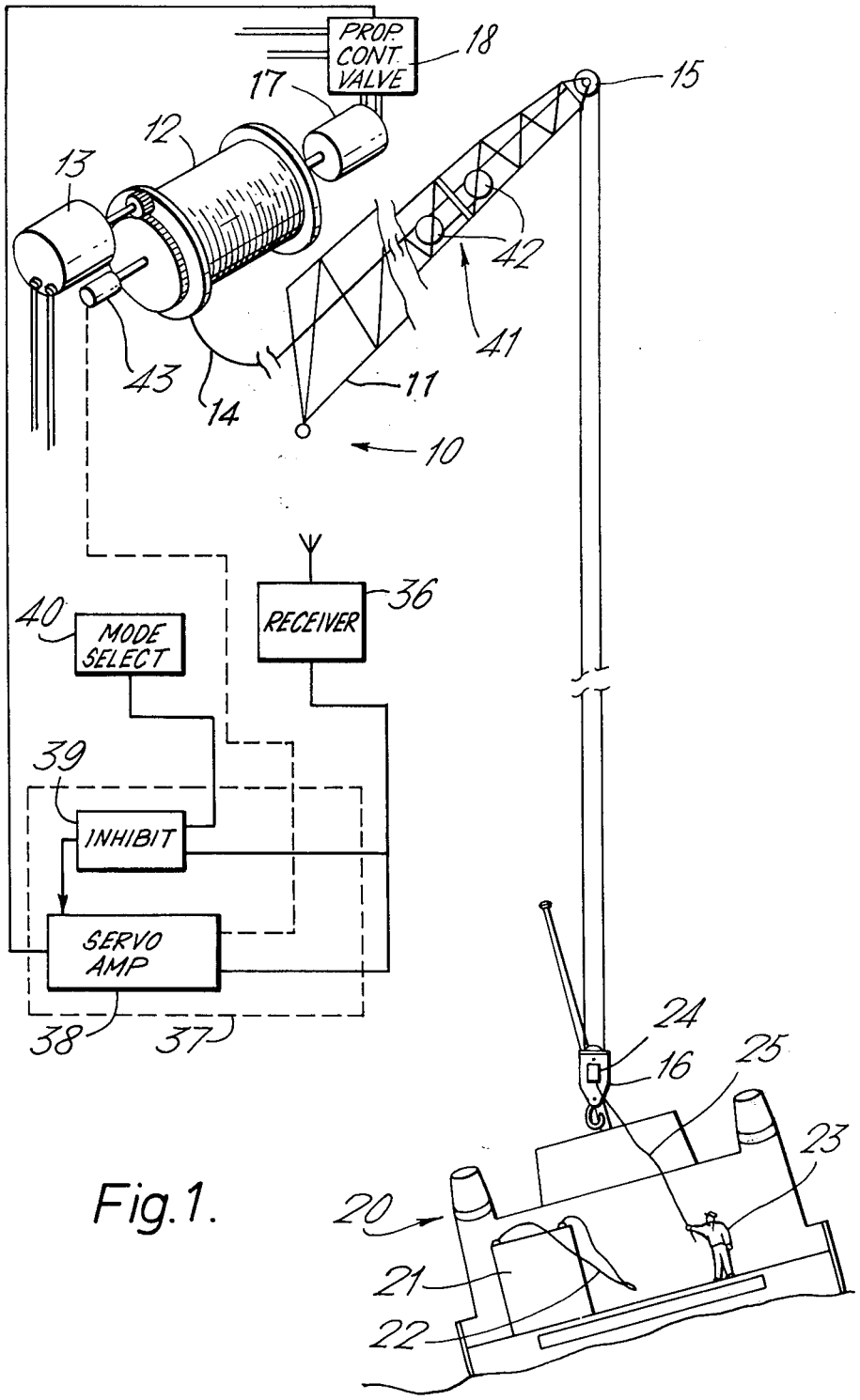

This invention relates to the transfer of loads between one of two relatively movable stations and a crane carried by the other station.

Where such transfer is required, for instance between vessels at sea, then as a hook assembly of the crane on a first vessel is brought to the other vessel horizontal components of relative movement between the hook assembly and the other vessel can be countered by normal slewing and luffing movements of the crane. Any failure to eliminate the horizontal motion completely is inconvenient, but unless the amplitude of such motion causes the hook assembly to approach the superstructure of the vessel, it is not considered unacceptably dangerous. On the other hand, vertical motion between the hook assembly and the vessel can be exceedingly dangerous to crew members and the vessel as the hook assembly must approach the deck of the vessel to have the load attached thereto or detached therefrom. Control of this vertical motion is determined by two factors. Firstly, where the crane has a hook assembly suspended by a cable, the motor used for lifting a load of many tons and the manner in which it is connected to a cable winch drum maybe unsuitable for making rapid correcting movements to the position of the hook assembly. Secondly, irrespective of the type of crane, the crane operator may be located in such a position that he is unable to judge the extent of vertical movements of the hook assembly and/or the other vessel in order to manoeuvre the hook assembly.

It is an object of the present invention to provide for a load transfer crane carried by a first of two relatively movable station means for controlling vertical motion of the crane hook assembly mitigating the above mentioned disadvantages.

According to the present invention control means for controlling the vertical motion of a hook assembly of a crane carried by a first of two relatively movable stations comprises transducer means carried by the hook assembly and operable to generate a signal related to deviation from a desired vertical separation between the second station and the hook assembly and a servo means responsive to an error signal received from the transducer to cause the hook assembly to be raised or lowered by the crane to restore the desired vertical separation.

The transducer means may include a control cord extending therefrom towards the second station, the transducer being arranged to provide no error signal while the control cord has a predetermined value of tension therein and an error signal operative to cause raising of the hook assembly when the value of the tension is less than the predetermined value and an error signal operative to cause lowering of the hook assembly when the tension exceeds the predetermined value.

The transducer means may comprise a potentiometer, arranged to be operatively connected between sources of potential of opposite polarity, having a slider arranged to provide the error signal such that when the slider is at a predetermined position between limits of travel a potential representing zero error signal is produced. The transducer means may include bias means operable to cause the slider to move to one end of the potentiometer in opposition to tension in the control cord.

In such arrangement the transducer means may also include means responsive to a tension in the control cord of less than a preset minimum value to inhibit operation of the control means.

The transducer means may include radio transmitter means to transmit signals produced in the transducer to a receiver on the station carrying the crane.

In this specification the term "hook assembly" is used to refer to that part of the crane to which a load is attached and is intended to include all other conventional arrangements for load attachment, such as electromagnets and lifting dogs.

Figure 2:
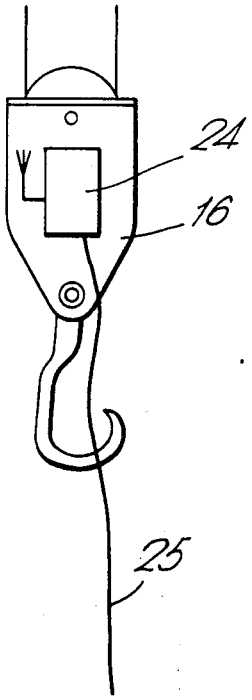
Figure 3:
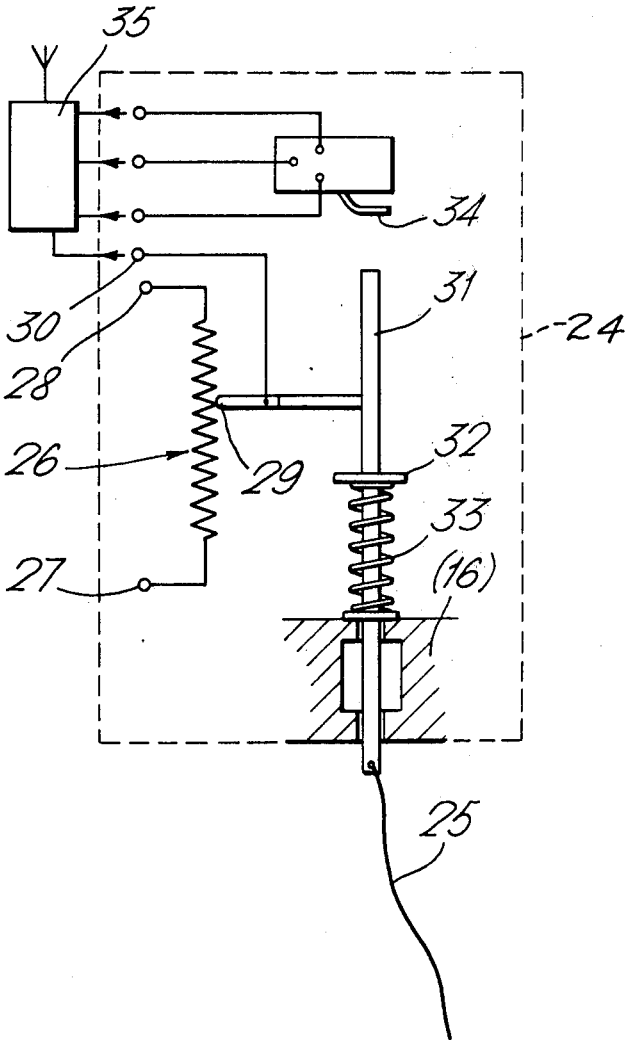

An embodiment of the present invention in which the crane has a hook assembly suspended by a rope will now be described by way of example with reference to the accompanying drawings, in which:

FIG. 1 is a schematic view of a crane control arrangement to illustrate operation of hook assembly control means according to the present invention, FIG. 2 is a side view of the crane hook assembly showing the general layout of the transducer means carried thereby, and FIG. 3 is a schematic representation of part of the transducer showing the electromechanical arrangement associated with a control cord thereof.

Referring to FIG. 1 a crane 10 is mounted on a first station (not shown) which may be a ship or a marine platform of the fixed or floating type and is arranged so as to make conventional slewing and luffing movement of a jib 11 under the control of an operator at a control station carried by the crane. The crane contains a winch drum 12 driven by as hydraulic motor 13 and upon which drum a crane rope 14 is wound. The rope 14 extends along the jib and over a pulley 15 from which the rope hangs vertically to support a crane hook assembly 16. The winch drum is also connected to be driven by a hydraulic servo motor 17 under the control of an electrically operated proportional control valve 18. The servo motor is not able to provide the lifting capacity of the main motor but is able to respond to control signals and control the drum more rapidly.

A second station 20 comprises a vessel smaller than the one on which the crane is carried which vessel consequently moves with respect to the first station, and therefore the hook assembly, with the prevailing wave motion of the sea. The vessel 20 carries a load 21, which is to be attached to the hook assembly by means of slings 22, and a crew member 23.

Referring to FIG. 2 wherein the hook assembly 16 is shown in greater detail, affixed to the hook assembly is a servo control transducer 24 including a control cord 25 which depends from the transducer and extends about 20 feet. The transducer is illustrated schematically in FIG. 3 and comprises a resistive potentiometer 26 having fixed terminals 27 and 28 and a slider 29 connected to an error signal terminal 30. The slider 29 is connected for movement by a plunger 31 which is supported by the body of hook assembly 16 and movable in relation thereto by means of the control cord 25. The plunger is provided with a shoulder 32 between which shoulder and the body of assembly 16 extends a bias spring 33. The positions of the shoulder and spring are arranged such that with no tension in the control cord the slider of the potentiometer is at one limit (the upper as shown) of its travel. In that position the plunger 31 is arranged to engage and operate a microswitch 34 which switch inhibits operation of the control means; that is, when the control cord is hanging freely the control means is inhibited and it only comes into operation when a force applied to the cord draws the plunger, and the potentiometer slider, away from its upward limit of travel against the bias of spring 33.

The transducer also contains a radio transmitter 35 by which the signals from the potentiometer slider and the inhibit switch 34 are relayed to a radio receiver 36 of the control system of the crane.

A control unit 37 (FIG. 1) carried by the crane includes a servo amplifier 38 to which error signals from the transducer 24 are received by way of receiver 36, which amplifier provides a servo signal to the proportional valve 18, and accordingly selects the speed of the servo motor 17. The control unit 37 also contains inhibiting means 39 which is arranged to respond to a "mode" selection switch 40 operable by the crane operator and to the inhibit switch 34 in the transducer to permit operation of the servo amplifier.

In operation, when it is desired to remove the load 21 from the vessel 20 the crane operator manoeuvres the crane by slewing and luffing actions and by unwinding rope from the drum 12 by means of the main motor 13 until the hook assembly 16 is positioned above the deck of the vessel by the length of the control cord 25, that is, about 20 feet. At this time the driver or crane operator selects servo control mode by operating switch 40 thereby applying a signal to the inhibit means 39. The crew member 23 acquires the cord and by pulling tensions it. The movement of the plunger 31 (FIG. 2) from its upper position produces a signal from the switch 34 which is also applied to the inhibit means 39 by way of the radio link. The inhibit means 39 removes the inhibit signal from the servo amplifier 38 and the potentiometer signal from the transducer 24 causes operation of the servo motor 17. The bias spring 33 is chosen such that a tension of about 15 lbs. causes the potentiometer slider to achieve a central position of travel in which zero error signal is applied to the servo motor. Whilst the cord is held thus (or tied to a cleat on the vessel) any increase of decrease in tension caused by vertical motion of the vessel is compensated for by the servo motor lengthening or shortening the rope. That is, the hook assembly follows the vertical motion of the vessel. Once the situation is established the crew member 23 increases the tension in the control cord 25 causing the hook assembly to approach the load, but still following the motion of the vessel. When the hook assembly is low enough the slings 22 are attached and the control cord tension released until the slings are held taut by the upward pull of the servo motor.

Upon a signal from the crew member 23, the crane operator uses the main hoist motor 13 to lift the load clear of the vessel as the control cord is released.

The servo control means of the present invention may be employed in conjunction with an arrangement 41 (FIG. 1) for maintaining constant tenstion in the rope. In that arrangement, the tension in the rope is determined as a function of the loading on pulleys 42 over which the rope passes. The pulley bearings may rest on load cells or may be caused to slide toward each other by rope tension against a restoring force of a hydraulic buffer acting as a rope accumulator for sudden changes in tension. Measured changes in tension are compared with a desired value of tension in means (not shown) and a control signal is applied to the valve 18 to cause servo motor 17 to maintain a constant tension in the rope 14 against the load to be lifted such that the slings 22 are held taut. In combination with the present invention such a facility can be selected when the control cord 25 is released and the control unit inhibited thereby preserving the vessel-following action of the hook assembly until the crane operator decides that conditions are suitable for lifting the load clear of the vessel by means of the main motor 13. The decision of when to begin lifting may be formed or assisted by a lift indicating arrangement forming the subject of copending application Ser. No. 772,254, filed Feb. 25, 1977

The control system described responds to a simple first order displacement error signal; as the control of hook position is achieved by winding rope on and off the drum 12 a tachogenerator 43 may be included to provide a second order velocity error signal to enable smoother vessel-following action of the crane hook.

It will be appreciated that as any horizontal movement between the hook assembly and the vessel has to be controlled by movements of the crane a crew member holding the control cord in tension will experience a component of tension due to such movements which might interfere with the control of vertical separation. This may be obviated by arranging for the plunger 31 of the transducer to encounter a large frictional resistance to movement when the control cord acts at greater than a predetermined oblique angle to the vertical.

It will also be appreciated that the transducer may take a form other than a resistive potentiometer, provided that an error signal is produced related to the tension in the control cord or otherwise related to the vertical separation between the hook assembly and the vessel. Similarly, means other than radio transmission may be employed to convey the transducer information to the control carried by the crane such as transmission ultrasonically or by the coupling of magnetic fields. Alternatively the transducer information can be carried by a wire embedded in the rope 14.

Furthermore, whereas the control unit 37 employs a simple analogue servo amplifier, the processing of error signal information from the transducer means, tachogenerator and inhibit means may be performed by a digital computer enabling other functions, such as interlocks between safe working load and jib angle, to be taken into account.

Where the structure of the crane is such as to make manoeuvering of the hook assembly by the main motor possible and giving the speed of response and linearity of control required, the main motor 13 may comprise the servo motor for the purpose of controlling the hook assembly vertical motion.

In the majority of applications the station carrying the crane will be relatively stable with respect to the earth, for example, on a large ship or platform or on a quayside while the station carrying the load moves relative to it. It will be appreciated that the station carrying the crane can undergo movement relative to a load stationary with respect to earth, for example, if the station is a ship or a helicopter, or both stations may undergo motion with respect to earth and each other, for example, a helicopter and ship, or two ships.

The crane, although described above as the type having a hook assembly suspended by a rope, may have the hook assembly carried by an articulated arm, movement of the hook assembly being achieved by rotating sections of the arm with respect to each other.

What we claim is:

1. Control means for controlling the vertical motion of a hook assembly of a crane carried by the first of two relatively movable stations comprising transducer means carried by the hook assembly operable to generate a signal related to deviation from a desired vertical separation between the second station and the hook assembly, and servo means responsive to an error signal received from the transducer means to cause the hook assembly to be raised or lowered by the crane to restore the desired vertical separation, the transducer means including a control cord extending therefrom to the section station, the transducer being arranged to provide no error signal when the control cord has a predetermined value of tension therein and an error signal operative to cause raising of the hook assembly when the value of the tension is less than the predetermined value and an error signal operative to cause lowering of the hook assembly when the tension exceeds the predetermined value, the tension in the control cord being controllable both by the motion of the second station relative to the hook assembly and manually by an operator on the second station, and further including a transmitter operable to transmit signals produced in the transducer and a receiver on the station carrying the crane operable to apply to the servo means signals received from the transmitter.

2. Control means as claimed in claim 1 in which the transmitter and receiver operate at radio frequency.

3. Control means as claimed in claim 1 in combination with a crane having a crane winch drum and a rope suspending the hook assembly, said rope including an electrical cable extending between the hook assembly and the crane winch drum and arranged to supply signals produced in the transducer means to the servo means.

4. Control means as claimed in claim 1 in which the transducer means comprises a potentiometer arranged to be operatively connected between sources of potential of opposite polarity and having a slider arranged to provide the error signal such that when the slider is at a predetermined position between the limits of travel a potential representing zero error signal is produced.

5. Control means as claimed in claim 4 including bias means operable to cause the slider to move to one end of the potentiometer in opposition to tension in the control cord.

6. Control means as claimed in claim 5 in which the transducer comprises first switching means responsive to the slider being at said one end of the potentiometer to provide an inhibit signal to the servo means and in which the serve means comprises an amplifier operable to receive signals from the transducer means, motor means responsive to an output signal of the amplifier to operate the crane winch in accordance with the magnitude and polarity of the signals, second switching means arranged to be operated manually, and inhibit means responsive to a signal received from the first or second switching means to inhibit an output signal of the amplifier.

7. Control means as claimed in claim 3 in which the servo means comprises an amplifier operable to receive signals from the transducer means and motor means responsive to an output signal of the amplifier to operate the crane winch drum in accordance with the magnitude and polarity of the signals.

8. Control means as claimed in claim 7 in which the motor means comprises a motor by which the hook is lifted.

9. Control means as claimed in claim 7 including a tachogenerator responsive to rotation of the motor means to provide a second order error signal to the amplifier means.

* * * * *